US012760384B2

(12) United States Patent
Shimoyama et al.

(10) Patent No.: US 12,760,384 B2
(45) Date of Patent: *Oct. 13, 2026

(54) METHOD OF MANUFACTURING GRAIN-ORIENTED ELECTRICAL STEEL SHEET AND ROLLING APPARATUS FOR MANUFACTURING ELECTRICAL STEEL SHEET

(71) Applicant: JFE STEEL CORPORATION, Tokyo (JP)

(72) Inventors: Yusuke Shimoyama, Tokyo (JP); Yukihiro Shingaki, Tokyo (JP); Hiroi Yamaguchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 422 days.

This patent is subject to a terminal disclaimer.

(21) Appl. No.: 18/260,473

(22) PCT Filed: Jan. 26, 2022

(86) PCT No.: PCT/JP2022/002953

§ 371 (c)(1),
(2) Date: Jul. 6, 2023

(87) PCT Pub. No.: WO2022/163723

PCT Pub. Date: Aug. 4, 2022

(65) Prior Publication Data

US 2024/0052448 A1 Feb. 15, 2024

(30) Foreign Application Priority Data

Jan. 28, 2021 (JP) ..... 2021-012208

(51) Int. Cl.
*C21D 8/1216* (2026.01)
*C21D 8/1244* (2026.01)
(Continued)

(52) U.S. Cl.
CPC ..... *C21D 8/1272* (2013.01); *C21D 8/1222* (2013.01); *C21D 8/1233* (2013.01);
(Continued)

(58) Field of Classification Search
CPC ..... C21D 8/1233; C21D 8/1266; B21B 3/02; B21B 1/22; B21B 1/28; B21B 1/36;
(Continued)

(56) References Cited

U.S. PATENT DOCUMENTS 3,933,024 A 1/1976 Matsumoto et al.
5,139,582 A 8/1992 Kurosawa et al.
(Continued)

FOREIGN PATENT DOCUMENTS

CN 1958812 A 5/2007
CN 105579596 A 5/2016
(Continued)

OTHER PUBLICATIONS

Computer-generated translation of JP 2011-224594 (A) (Title: Cold rolling method; Applicants: Jfe Steel Corp; Inventors: Ueno Masayasu, Harada Etsumitsu), originally published on 2011-11-10. (Year: 2011).*

(Continued)

*Primary Examiner* — Vanessa T. Luk
(74) *Attorney, Agent, or Firm* — KENJA IP LAW PC

(57) ABSTRACT

Provided is a method of manufacturing a grain-oriented electrical steel sheet, with which a grain-oriented electrical steel sheet with low iron loss and little variation in iron loss can be stably manufactured by a tandem mill. The method includes subjecting a steel material to hot rolling to obtain a hot-rolled sheet, subjecting the hot-rolled sheet to cold rolling once or twice or more with intermediate annealing performed therebetween to obtain a cold-rolled sheet with a final sheet thickness, and then subjecting the cold-rolled
(Continued)

sheet to decarburization annealing and then to secondary recrystallization annealing, wherein final cold rolling is performed by a tandem mill, and in the final cold rolling, the hot-rolled sheet is heated to a temperature range of 70° C. or higher and 200° C. or lower, then cooled to 60° C. or lower, and then introduced into a first pass of the tandem mill.

5 Claims, 1 Drawing Sheet

(51) Int. Cl.
*C21D 9/46* (2006.01)
*C22C 38/02* (2006.01)
*C22C 38/04* (2006.01)

(52) U.S. Cl.
CPC ..... *C21D 9/46* (2013.01); *C22C 38/02* (2013.01); *C22C 38/04* (2013.01); *C21D 2201/05* (2013.01)

(58) Field of Classification Search
CPC ... B21B 2001/221; B21B 37/74; B21B 45/00; B21B 2045/00
See application file for complete search history.

(56) References Cited

U.S. PATENT DOCUMENTS

| | | | | |
|---|---|---|---|---|
| 5,296,050 | A | 3/1994 | Takamiya et al. | |
| 5,666,842 | A * | 9/1997 | Komatsubara | B21B 37/74 72/85 |
| 6,039,818 | A * | 3/2000 | Toge | C21D 8/1233 148/307 |
| 2009/0199935 | A1* | 8/2009 | Sakakura | C21D 9/70 148/541 |
| 2014/0311629 | A1 | 10/2014 | Fortunati et al. | |
| 2016/0196909 | A1 | 7/2016 | Takenaka et al. | |
| 2020/0230673 | A1* | 7/2020 | Fukushima | C21D 6/008 |
| 2022/0033921 | A1 | 2/2022 | Shingaki et al. | |

FOREIGN PATENT DOCUMENTS

| | | | |
|---|---|---|---|
| EP | 0475710 | A2 | 3/1992 |
| EP | 4357468 | A1 | 4/2024 |
| GB | 1459644 | A | 12/1976 |
| JP | S5016610 | A | 2/1975 |
| JP | S6115919 | A | 1/1986 |
| JP | H01215925 | A | 8/1989 |
| JP | H04120216 | A | 4/1992 |
| JP | H0533056 | A | 2/1993 |
| JP | H0615307 | A | 1/1994 |
| JP | H08253816 | A | 10/1996 |
| JP | H08269553 | A | 10/1996 |
| JP | H09157745 | A | 6/1997 |
| JP | 3160281 | B2 | 4/2001 |
| JP | 2003193132 | A | 7/2003 |
| JP | 2005262217 | A | 9/2005 |
| JP | 2006299297 | A | 11/2006 |
| JP | 2011052302 | A | 3/2011 |
| JP | 2011224594 | A | 11/2011 |
| JP | 2014208895 | A | 11/2014 |
| JP | 2016156069 | A * | 9/2016 |
| JP | 2020116587 | A | 8/2020 |
| JP | 2020164907 | A | 10/2020 |
| KR | 10-0169734 | B1 | 1/1999 |
| WO | 9013673 | A1 | 11/1990 |
| WO | 2020067236 | A1 | 4/2020 |

OTHER PUBLICATIONS

Sep. 18, 2024, the Extended European Search Report issued by the European Patent Office in the corresponding European Patent Application No. 22745942.7.

Apr. 12, 2022, International Search Report issued in the International Patent Application No. PCT/JP2022/002953.

Jun. 6, 2023, Notification of Reasons for Refusal issued by the Japan Patent Office in the corresponding Japanese Patent Application No. 2022-528170 with English language Concise Statement of Relevance.

Aug. 1, 2025, Office Action issued by the Korean Intellectual Property Office in the corresponding Korean Patent Application No. 10-2023-7022055 with English language concise statement of relevance.

May 22, 2024, the Partial Supplementary European Search Report issued by the European Patent Office in the corresponding European Patent Application No. 22745942.7.

Dec. 27, 2025, Office Action issued by the China National Intellectual Property Administration in the corresponding Chinese Patent Application No. 202280010754.8 with English language search report.

* cited by examiner

METHOD OF MANUFACTURING GRAIN-ORIENTED ELECTRICAL STEEL SHEET AND ROLLING APPARATUS FOR MANUFACTURING ELECTRICAL STEEL SHEET

TECHNICAL FIELD

This disclosure relates to a method of manufacturing a grain-oriented electrical steel sheet with excellent magnetic properties.

BACKGROUND

A grain-oriented electrical steel sheet is a soft magnetic material used as an iron core material of transformers and generators, and it is a steel sheet with excellent magnetic properties having a crystalline structure where {110}<001> orientation (Goss orientation), which is an easy magnetization axis of iron, is highly accorded with the rolling direction of the steel sheet.

JP S50-016610 A (PTL 1) describes a method of subjecting a cold-rolled sheet during cold rolling to heat treatment at low temperatures and to aging treatment, as an example of a method of increasing the intensity of the Goss orientation. In addition, JP H08-253816 A (PTL 2) describes a technology of setting the cooling rate during hot-rolled sheet annealing or intermediate annealing before final cold rolling to 30° C./s or higher and further performing aging treatment between passes twice or more for two minutes or longer at a sheet temperature of 150° C. to 300° C. during final cold rolling. Further, JP H01-215925 A (PTL 3) describes a technology that utilizes dynamic strain aging, in which dislocations introduced during rolling are immediately fixed with C or N by raising the steel sheet temperature during rolling and performing warm rolling.

All of the technologies described in PTLS 1 to 3 maintain the steel sheet temperature at an appropriate temperature before cold rolling, during rolling, or between passes of cold rolling, thereby diffusing carbon (C) and nitrogen (N), which are solute elements, at low temperatures to fix the dislocations introduced by cold rolling. As a result, the movement of dislocations in subsequent rolling processes is suppressed and shear deformation is further caused to improve the texture obtained by rolling. By applying these technologies, many Goss-orientation seed crystals are formed when the steel sheet is a primary recrystallized sheet. Those Goss-orientation seed crystal grains develop during secondary recrystallization, which increases the intensity of the Goss orientation after secondary recrystallization.

JP H09-157745 A (PTL 4) describes a technology to further enhance the effect of the above-mentioned strain aging, in which fine carbides are precipitated in steel in an annealing process immediately before final cold rolling of a cold rolling process, where the final cold rolling is divided into a first half and a second half, rolling is performed at a low temperature of 140° C. or lower with a rolling reduction of 30% to 75% in the first half, rolling is performed at a high temperature of 150° C. to 300° C. with at least two reduction passes in the second half, and the total rolling reduction of the first half and the second half is 80% to 95%, to stably obtain a material in which grains are highly accorded with the Goss orientation. In addition, JP 3160281 B (PTL 5) describes a technology of performing heat treatment at 50° C. to 150° C. for 30 seconds to 30 minutes under a tension of 0.5 kg/mm$^2$ or more before cold rolling performed by a tandem mill to precipitate fine carbides in steel.

CITATION LIST

Patent Literature

PTL 1: JP S50-016610 A
PTL 2: JP H08-253816 A
PTL 3: JP H01-215925 A
PTL 4: JP H09-157745 A
PTL 5: JP 3160281 B

SUMMARY

Technical Problem

In recent years, demands for low-iron loss grain-oriented electrical steel sheets are increasing due to social demand for energy saving, and it is desired to develop technologies that can achieve stable mass production of grain-oriented electrical steel sheets with lower iron loss.

A tandem mill has a larger throughput per hour than a reverse mill such as a Sendzimir mill, which is advantageous for mass production of grain-oriented electrical steel sheets. However, the technologies described in PTLS 1 and 2, in which aging treatment is performed between passes during rolling, cannot achieve the desired effect in cases where the distance between passes is short and the line speed is fast, such as in tandem rolling.

In addition, the method described in PTL 3, in which heating and rolling are performed at the entry side of a tandem mill, cannot sufficiently improve the iron loss properties, as described below. It is believed that primary recrystallized Goss-orientation grains are formed by nucleation in a shear band introduced into a {111}<112> matrix structure, which is one of the stable orientations of rolling. In the method described in PTL 3 where a steel sheet is heated at the entry side of a tandem mill and subjected to rolling while maintaining the temperature, it is difficult to create a {111}<112> matrix structure. As a result, the amount of Goss-orientation grain in the primary recrystallized structure is insufficient, and the iron loss properties cannot be sufficiently improved.

In the technologies described in PTLS 4 and 5 where carbide precipitation treatment is performed in an annealing process before final cold rolling, the precipitation form of carbide changes over time depending on the elapsed time between the precipitation treatment and the final cold rolling, which leads to a change in the texture. As a result, large variations in iron loss are caused in a product coil.

It could thus be helpful to provide a method of manufacturing a grain-oriented electrical steel sheet, with which a grain-oriented electrical steel sheet with low iron loss and little variation in iron loss can be stably manufactured by a tandem mill.

Solution to Problem

To solve the problems, we have diligently studied the technologies of performing heat treatment before cold rolling. The following describes the experiments that led to the present disclosure.

A steel slab having a composition containing, in mass %, C: 0.037%, Si: 3.4%, and Mn: 0.05%, and containing, in mass ppm, 31 ppm of S, 31 ppm of Se, 50 ppm of N, and 85 ppm of sol. Al, with the balance being Fe and inevitable impurities, was heated to 1210° C. and then subjected to hot rolling to obtain a hot-rolled sheet with a sheet thickness of 2.0 mm.

The hot-rolled sheet was subjected to hot-rolled sheet annealing at 1000° C. for 60 seconds, then cooled from 800° C. to 300° C. at a rate of 20° C./s, and then wound into a coil. The hot-rolled sheet obtained after hot-rolled sheet annealing was subjected to cold rolling once using a tandem mill (roll diameter: 300 mm, number of stands: 5) to obtain a cold-rolled sheet with a final sheet thickness of 0.20 mm. In this process, the steel sheet (hot-rolled sheet) discharged from a payoff reel was heated to the heating temperature listed in Table 1 by a heating unit installed between the payoff reel and the first pass of rolling stands in the tandem mill. Two types of coils were prepared: a coil where the steel sheet was bitten in the first pass of rolling stands at the same temperature after heating, and a coil where the steel sheet was cooled to room temperature (25° C.) after heating and then bitten in the first pass of rolling stands. Further, a coil was prepared where the steel sheet was bitten in the first pass of rolling stands at room temperature without heating.

Next, the cold-rolled sheet was subjected to primary recrystallization annealing that also served as decarburization annealing at a soaking temperature of 840° C. for a soaking time of 100 seconds. Next, an annealing separator mainly composed of MgO was applied to the surface of the steel sheet, and then the steel sheet was subjected to secondary recrystallization annealing.

A coating solution containing phosphate-chromate-colloidal silica in a weight ratio of 3:1:2 was applied to the surface of the steel sheet after the secondary recrystallization annealing, and flattening annealing was performed at 800° C. for 30 seconds to obtain a product coil.

The iron loss of each of 10 product coils prepared under the same conditions was measured, and the average value and the standard deviation were determined. The iron loss was measured by cutting samples from the longitudinal central portion of the coil so that the total weight was 500 g or more, and conducting an Epstein test. The average value and the standard deviation of the iron loss are listed in Table 1.

TABLE 1

| Condition No. | Heating temperature (° C.) | First-pass introduction temperature (° C.) | Iron loss $W_{17/50}$ (W/kg) Average value | Standard deviation | Remarks |
|---|---|---|---|---|---|
| 1 | No heating | 25 | 1.10 | 0.13 | Comparative Example |
| 2 | 50 | Same as left (without cooling) | 1.08 | 0.11 | Comparative Example |
| 3 | 50 | 25 | 1.10 | 0.10 | Comparative Example |
| 4 | 60 | Same as left (without cooling) | 1.10 | 0.12 | Comparative Example |
| 5 | 60 | 25 | 1.09 | 0.09 | Comparative Example |
| 6 | 70 | Same as left (without cooling) | 1.01 | 0.09 | Comparative Example |
| 7 | 70 | 25 | 0.90 | 0.04 | Example |
| 8 | 80 | Same as left (without cooling) | 1.05 | 0.03 | Comparative Example |
| 9 | 80 | 25 | 0.88 | 0.02 | Example |
| 10 | 90 | Same as left (without cooling) | 1.13 | 0.04 | Comparative Example |
| 11 | 90 | 25 | 0.87 | 0.04 | Example |
| 12 | 100 | Same as left (without cooling) | 1.09 | 0.05 | Comparative Example |
| 13 | 100 | 25 | 0.85 | 0.03 | Example |
| 14 | 125 | Same as left (without cooling) | 1.07 | 0.02 | Comparative Example |
| 15 | 125 | 25 | 0.86 | 0.02 | Example |
| 16 | 150 | Same as left (without cooling) | 1.20 | 0.04 | Comparative Example |
| 17 | 150 | 25 | 0.82 | 0.03 | Example |
| 18 | 175 | Same as left (without cooling) | 1.25 | 0.05 | Comparative Example |
| 19 | 175 | 25 | 0.79 | 0.04 | Example |
| 20 | 200 | Same as left (without cooling) | Could not be evaluated because it broke during rolling | | Comparative Example |
| 21 | 200 | 25 | 0.80 | 0.04 | Example |
| 22 | 225 | Same as left (without cooling) | Could not be evaluated because it broke during rolling | | Comparative Example |
| 23 | 225 | 25 | 1.05 | 0.05 | Comparative Example |
| 24 | 250 | Same as left (without cooling) | Could not be evaluated because it broke during rolling | | Comparative Example |
| 25 | 250 | 25 | 1.21 | 0.04 | Comparative Example |

Table 1 indicates that, when the steel sheet is heated to a temperature range of 70° C. or higher and 200° C. or lower prior to being introduced into the first pass of the tandem mill for cold rolling, variations in the iron loss of the coil are reduced. Further, Table 1 indicates that the iron loss is low when the heated steel sheet is cooled prior to being introduced into the first pass of the tandem mill for cold rolling.

Although the mechanism of the reduction of iron loss and the improvement of iron loss variation properties in the above experimental results is not clear, we consider as follows. The mechanism of the improvement of iron loss variation properties is considered as follows. During the cold rolling, the steel sheet was once heated after it was discharged from the payoff reel and before it was bitten in the first pass, so that the time between the heat treatment and the biting in the first pass was constant for the 10 coils, and the change over time of fine carbides precipitated due to the heat treatment (the heating before biting) was temporarily suppressed.

The mechanism of low iron loss when the steel sheet is cooled after it is heated and before it is bitten in the first pass is considered as follows. It is believed that primary recrystallized Goss-orientation grains are formed by nucleation in a shear band introduced into a {111}<112> matrix structure, which is one of the stable orientations of rolling. As in the above experiments, when fine carbides were precipitated by heating the steel sheet and the temperature at the time of biting was set to a low temperature, the low-temperature rolling process created a {111}<112> matrix structure and accelerated the local formation of shear band due to the fine carbides, which effectively increased the Goss-orientation grains.

This disclosure is based on the above-mentioned discoveries and further studies.

Specifically, primary features of the present disclosure are as follows.

[1] A method of manufacturing a grain-oriented electrical steel sheet, comprising subjecting a steel material to hot rolling to obtain a hot-rolled sheet, subjecting the hot-rolled sheet to cold rolling once or twice or more with intermediate annealing performed therebetween to obtain a cold-rolled sheet with a final sheet thickness, and then subjecting the cold-rolled sheet to decarburization annealing and then to secondary recrystallization annealing, wherein final cold rolling is performed by a tandem mill, and in the final cold rolling, the hot-rolled sheet is heated to a temperature range of 70° C. or higher and 200° C. or lower, then cooled to 60° C. or lower, and then introduced into a first pass of the tandem mill.

[2] The method of manufacturing a grain-oriented electrical steel sheet according to aspect [1], wherein the steel material comprises a chemical composition containing, in mass %, C: 0.01% to 0.10%,
Si: 2.0% to 4.5%,
Mn: 0.01% to 0.5%,
Al: 0.01% to 0.04%,
S: 0.01% to 0.05%,
Se: 0.01% to 0.05%, and
N: 0.0050% to 0.012%, with the balance being Fe and inevitable impurities.

[3] The method of manufacturing a grain-oriented electrical steel sheet according to aspect [1], wherein the steel material comprises a chemical composition containing, in mass %, C: 0.01% to 0.10%,
Si: 2.0% to 4.5%,
Mn: 0.01% to 0.5%,
Al: less than 0.0100%,
S: 0.0070% or less,
Se: 0.0070% or less, and
N: 0.0050% or less, with the balance being Fe and inevitable impurities.

[4] The method of manufacturing a grain-oriented electrical steel sheet according to aspect [2] or [3], wherein the steel material further contains, in mass %, at least one selected from the group consisting of Sb: 0.005% to 0.50%,
Cu: 0.01% to 1.50%,
P: 0.005% to 0.50%,
Cr: 0.01% to 1.50%,
Ni: 0.005% to 1.50%,
Sn: 0.01% to 0.50%,
Nb: 0.0005% to 0.0100%,
Mo: 0.01% to 0.50%,
B: 0.0010% to 0.007%, and
Bi: 0.0005% to 0.05%.

[5] A rolling apparatus for manufacturing an electrical steel sheet, comprising a heating unit and a cooling unit at an entry side of a first stand of a tandem mill for manufacturing an electrical steel sheet.

As used herein, the "final cold rolling" refers to cold rolling in which the steel sheet obtains the final sheet thickness after the cold rolling. Specifically, for cold rolling performed once or twice or more with intermediate annealing performed therebetween, it refers to the cold rolling when cold rolling is performed once, and it refers to the second cold rolling when cold rolling is performed twice.

Advantageous Effect

According to the present disclosure, it is possible to stably manufacture a grain-oriented electrical steel sheet with excellent magnetic properties by a tandem mill while suppressing variations in iron loss among coils.

DETAILED DESCRIPTION

Figure 1A:
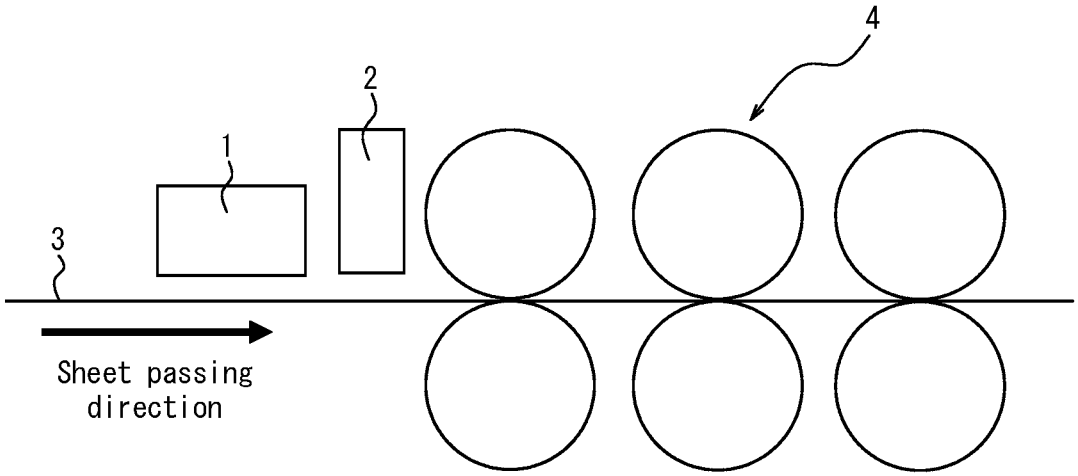
FIG. 1A schematically illustrates a part of a rolling apparatus applicable to the present disclosure.

The following describes the present disclosure in detail.

<Steel Material>

In addition to slabs, blooms and billets can be used as steel materials in the manufacturing method of the present disclosure. For example, a steel slab manufactured with a known manufacturing method can be used. Examples of the manufacturing method include steelmaking and continuous casting, and ingot casting and blooming. During the steelmaking, molten steel obtained in a converter, an electric furnace, or the like is subjected to secondary refining such as vacuum degassing to obtain a desired chemical composition.

The chemical composition of the steel material may be a chemical composition for manufacturing a grain-oriented electrical steel sheet and may contain known components for a grain-oriented electrical steel sheet. It preferably contains C, Si, and Mn, from the viewpoint of manufacturing a grain-oriented electrical steel sheet with excellent magnetic properties. Preferred contents of C, Si and Mn may be as follows. As used herein, "%" of each component is a mass percentage unless otherwise specified.

C: 0.01% to 0.10%

C is an element necessary for improving the primary recrystallized texture by precipitating fine carbides. When the C content is more than 0.10%, it is difficult to reduce, by decarburization annealing, the content to 0.0050% or less that causes no magnetic aging. On the other hand, when the content is less than 0.01%, the precipitation of fine carbide is insufficient, and the effect of improving the texture is insufficient. Therefore, the C content is preferably 0.01% to 0.10%. It is more preferably 0.01% to 0.08%.

Si: 2.0% to 4.5%

Si is an element effective in increasing the electric resistance of steel and improving the iron loss properties. When the Si content is more than 4.5%, the workability is significantly deteriorated, rendering it difficult to manufacture steel sheets by rolling. On the other hand, when the content is less than 2.0%, it is difficult to obtain sufficient iron loss reducing effect. Therefore, the Si content is preferably 2.0% to 4.5%. It is more preferably 2.5% to 4.5%.

Mn: 0.01% to 0.5%

Mn is an element necessary for improving hot workability. When the Mn content is more than 0.5%, the primary recrystallized texture is deteriorated, rendering it difficult to obtain secondary recrystallized grains highly accorded with the Goss orientation. On the other hand, when the content is less than 0.01%, it is difficult to obtain sufficient hot rolling workability. Therefore, the Mn content is preferably 0.01% to 0.5%. The Mn content is more preferably 0.03% to 0.5%.

In addition to the above-mentioned C, Si, and Mn, the chemical composition of the steel material may contain Al: 0.01% to 0.04% and N: 0.0050% to 0.012% as inhibitor components in secondary recrystallization. When the Al content and the N content are less than the lower limits, it may be difficult to obtain predetermined effects of inhibitors. On the other hand, when the contents exceed the upper limits, precipitates disperse unevenly, and it may also be difficult to obtain predetermined effects of inhibitors.

Further, S: 0.01% to 0.05% and Se: 0.01% to 0.05% may be contained as inhibitor components, in addition to Al and N. By containing these elements, sulfides (such as MnS and $Cu_2S$) and selenides (such as MnSe and $Cu_2Se$) can be formed. Sulfides and selenides may be precipitated in combination. When the S content and the Se content are less than the lower limits, it is difficult to obtain sufficient effects of inhibitors. On the other hand, when the contents exceed the upper limits, precipitates disperse unevenly, and it is also difficult to obtain sufficient effects of inhibitors.

The chemical composition may be adjusted so that it is suitable for an inhibitor-less system, by suppressing the Al content to less than 0.0100%. In this case, the N content may be 0.0050% or less, the S content may be 0.0070% or less, and the Se content may be 0.0070% or less.

In addition to the above elements, it is possible to further contain at least one selected from the group consisting of Sb: 0.005% to 0.50%, Cu: 0.01% to 1.50%, P: 0.005% to 0.50%, Cr 0.01% to 1.50%, Ni: 0.005% to 1.50%, Sn: 0.01% to 0.50%, Nb: 0.0005% to 0.0100%, Mo: 0.01% to 0.50%, B: 0.0010% to 0.007%, and Bi: 0.0005% to 0.05%, to improve the magnetic properties. Sb, Cu, P, Cr, Ni, Sn, Nb, Mo, B, and Bi are elements useful for improving magnetic properties. When they are contained, their contents are preferably within the above ranges, from the viewpoint of sufficiently obtaining the magnetic property improving effect without inhibiting the development of secondary recrystallized grains.

The balance other than the above-mentioned components in the chemical composition of the steel material is Fe and inevitable impurities.

<Manufacturing Process>

In the manufacturing method of the present disclosure, a steel material such as a steel slab is subjected to hot rolling to obtain a hot-rolled sheet. The steel material may be heated before subjection to hot rolling. The heating temperature in this case is preferably about 1050° C. or higher from the viewpoint of ensuring hot rolling manufacturability. The upper limit of the heating temperature is not particularly limited. However, temperatures above 1450° C. are close to the melting point of steel, rendering it difficult to keep the shape of the steel material such as a steel slab. Therefore, the temperature is preferably 1450° C. or lower.

Other hot rolling conditions are not particularly limited, and conventional conditions may be applied.

The obtained hot-rolled sheet may be subjected to hot-rolled sheet annealing. Hot-rolled sheet annealing is preferably performed especially when the subsequent cold rolling is performed once. In some cases, descaling by pickling or the like may be performed after hot-rolled sheet annealing and before cold rolling.

Next, the hot-rolled sheet (or the hot-rolled sheet obtained after hot-rolled sheet annealing) is subjected to cold rolling once to obtain a cold-rolled sheet with a final sheet thickness, or subjected to cold rolling twice or more with intermediate annealing performed therebetween to obtain a cold-rolled sheet with a final sheet thickness. The total rolling reduction of cold rolling is not particularly limited, and it may be 70% or more and 95% or less. The rolling reduction of final cold rolling is not particularly limited, and it may be 60% or more and 95% or less. The final sheet thickness is not particularly limited, and it may be 0.1 mm or more and 1.0 mm or less, for example.

The maximum temperature for the annealing before final cold rolling, that is, the hot-rolled sheet annealing in the case of performing cold rolling once and the intermediate annealing in the case of performing cold rolling twice or more, is preferably 900° C. or higher and 1200° C. or lower. The average cooling rate in the temperature range from 800° C. to 300° C. during the cooling of the annealing before final cold rolling is preferably 15° C./s or higher. It is more preferably 20° C./s or higher.

The final cold rolling is performed by a tandem mill. When the steel sheet (hot-rolled sheet) is discharged from a payoff reel and before it is introduced into the first pass of the tandem mill, the steel sheet is heated to a temperature range of 70° C. or higher and 200° C. or lower and then cooled to 60° C. or lower. In other words, the temperature of the steel sheet when the steel sheet is introduced into the first pass of the tandem mill is 60° C. or lower. Since the fine carbides precipitated during the heating may be coarsened, the cooling is preferably performed within 30 seconds and more preferably within 15 seconds, after the heating. Rolling other than the final cold rolling, that is, the first cold rolling in the case of performing rolling twice, may be performed by a tandem mill or by a reverse rolling mill such as a Sendzimir mill.

When the heating temperature is lower than 70° C., fine carbides are not sufficiently precipitated. On the other hand, when the heating temperature exceeds 200° C., the diffusion rate of carbon is excessively increased, and coarse carbides are precipitated. As a result, the effect of improving the texture by strain aging is lost, and the magnetic properties are deteriorated. The heating temperature is preferably 100° C. or higher and 170° C. or lower.

When the cooling temperature after heating exceeds 60° C., a {111}<112> matrix structure cannot be sufficiently formed, and the effect of improving the texture by heating is lost. The lower limit is not particularly set. However, if the temperature is 0° C. or lower, the material becomes brittle, which has an adverse effect on manufacturability. Therefore, the temperature of the steel sheet when it is bitten in the first pass is preferably above 0° C.

To create a {111}<112> matrix structure in the first pass of the final cold rolling and to suppress shear deformation during the rolling, the roughness of work rolls in the first pass (first stand) of the tandem mill is preferably low. Specifically, the arithmetic mean roughness Ra of the first pass of the tandem mill is preferably 1.0 μm or less and more preferably 0.5 μm or less.

The heating method is not particularly limited, and examples thereof include air bath, oil bath, sand bath, induction heating, and injection of heated lubricating oil or heated water to the steel sheet. However, because the heating is performed at the entry side of the tandem mill, methods that allow heating in a short time are preferred. The heating temperature is the temperature of the steel sheet on the delivery side of a heating unit.

The method of cooling after heating is not particularly limited, and examples thereof include injection of coolant liquid to the steel sheet, roll cooling, and oil bath. However, because cooling is performed at the entry side of the tandem mill, it is necessary to cool the steel sheet in a short time.

Although the above means are available as cooling methods, it is desirable to be able to independently control the temperature of a heat releasing medium so that the steel sheet can be cooled to a desired temperature before it is bitten in the first pass.

Heat treatment such as aging treatment, or warm rolling may be interposed between cold rolling. However, it is preferably a method in which the final rolling is divided into a first half and a second half, and rolling is performed at low temperatures in the first half and at high temperatures in the second half, as described in the PTL 4.

In the manufacturing method of the present disclosure, a cold-rolled sheet with a final sheet thickness may be subjected to decarburization annealing and then to secondary recrystallization annealing to obtain a grain-oriented electrical steel sheet. After secondary recrystallization annealing, an insulating coating may be applied on the steel sheet.

The conditions of the decarburization annealing are not particularly limited. In general, decarburization annealing often serves as primary recrystallization annealing, and decarburization annealing can also serve as primary recrystallization annealing in the manufacturing method of the present disclosure. In such a case, the conditions are not particularly limited, and conventional conditions may be applied. For example, the annealing may be performed at 800° C. for 2 minutes in a hot hydrogen atmosphere.

After subjecting the cold-rolled sheet to decarburization annealing, final annealing (secondary recrystallization annealing) is performed for secondary recrystallization. Before the final annealing, an annealing separator may be applied to the surface of the steel sheet. The annealing separator is not particularly limited, and known ones can be used. Examples thereof include an annealing separator mainly composed of MgO in which $TiO_2$ or the like is added if necessary, and an annealing separator mainly composed of $SiO_2$ or $Al_2O_3$.

After performing secondary recrystallization annealing, it is preferable to coat the surface of the steel sheet with an insulating coating, bake the steel sheet, and if necessary, perform flattening annealing to adjust the shape of the steel sheet. The type of the insulating coating is not particularly limited. In a case of forming an insulating coating that imparts tensile strength to the surface of the steel sheet, it is preferable to use a coating solution containing phosphate-colloidal silica, such as those described in JP S50-79442 A, JP S48-39338 A, and JP S56-75579 A, and bake the steel sheet at about 800° C.

<Rolling Apparatus for Manufacturing Electrical Steel Sheet>

The rolling apparatus for manufacturing an electrical steel sheet of the present disclosure is provided with a heating unit and a cooling unit at the entry side of a first stand of a tandem mill for manufacturing an electrical steel sheet. With this apparatus, the above-mentioned grain-oriented electrical steel sheet can be stably manufactured.

Figure 1B:
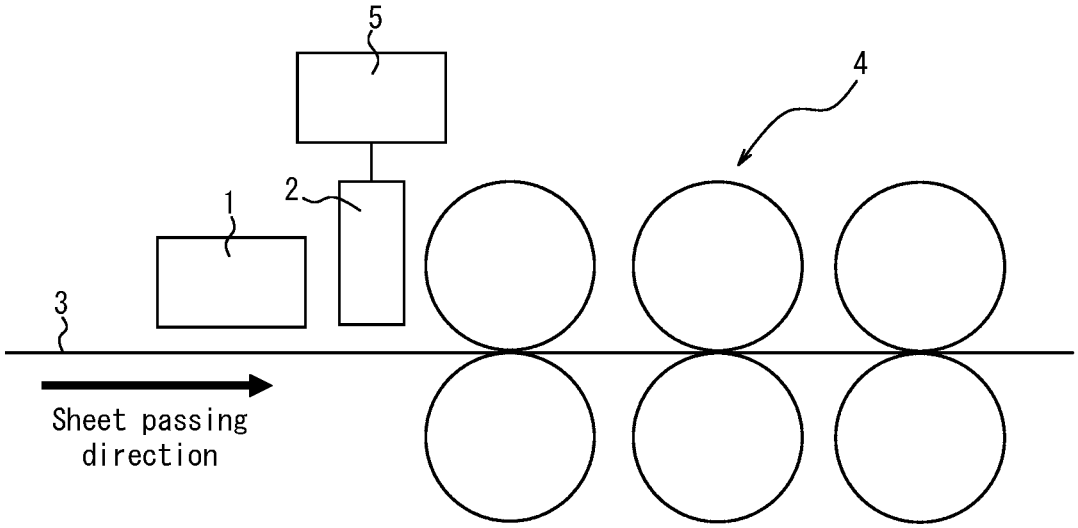
FIG. 1B schematically illustrates a part of a rolling apparatus applicable to the present disclosure.

FIG. 1A is a partial overview of the rolling apparatus. In the apparatus illustrated in FIG. A, a heating unit 1 and a cooling unit 2 are arranged upstream of the entry side of the first pass (first stand) of rolling stands (rolling rolls) 4 of a tandem mill. With this configuration, a steel strip 3 (hot-rolled sheet) immediately before being introduced into the tandem mill can be heated by the heating unit 1 and then cooled by the cooling unit 2. The rolling apparatus may be provided with a temperature control unit 5 capable of controlling the temperature of a heat releasing medium in the cooling unit 2, as illustrated in FIG. 1B.

EXAMPLES

Example 1

A steel slab having a composition containing C: 0.037 mass %, Si: 3.4 mass %, and Mn: 0.05 mass %, and containing 31 mass ppm of S, 31 mass ppm of Se, 50 mass ppm of N, and 85 mass ppm of sol. Al, with the balance being Fe and inevitable impurities, was heated to 1210° C. and then subjected to hot rolling to obtain a hot-rolled sheet with a sheet thickness of 2.0 mm.

The hot-rolled sheet was subjected to hot-rolled sheet annealing at 1000° C. for 60 seconds, then cooled from 800° C. to 300° C. at a rate of 15° C./s, and then wound into a coil. The hot-rolled sheet obtained after hot-rolled sheet annealing was subjected to cold rolling once using a tandem mill (roll diameter: 300 mm, number of stands: 5) to obtain a cold-rolled sheet with a final sheet thickness of 0.20 mm. In this process, the steel sheet (hot-rolled sheet) was heated to 150° C. by a heating unit installed between a payoff reel and the first pass of rolling stands in the tandem mill. After heating, the steel sheet was cooled to the temperature (first-pass introduction temperature) listed in Table 2, and then bitten in the first pass of rolling stands. Regarding the roughness of work rolls (arithmetic mean roughness Ra) of the first pass, rolls of 1.5 μm were used in Condition Nos. 26 to 34 of Table 2, and rolls of 0.9 μm were used in Condition Nos. 35 to 37 of Table 2.

Next, the cold-rolled sheet was subjected to primary recrystallization annealing that also served as decarburization annealing at a soaking temperature of 840° C. for a soaking time of 100 seconds. Next, an annealing separator mainly composed of MgO was applied to the surface of the steel sheet, and then the steel sheet was subjected to secondary recrystallization annealing.

A coating solution containing phosphate-chromate-colloidal silica in a weight ratio of 3:1:2 was applied to the surface of the steel sheet after the secondary recrystallization annealing, and flattening annealing was performed at 800° C. for 30 seconds to obtain a product coil.

The iron loss of each of 10 product coils prepared under the same conditions was measured, and the average value and the standard deviation were determined. The iron loss was measured by cutting samples from the longitudinal central portion of the coil so that the total weight was 500 g or more, and conducting an Epstein test. The average value and the standard deviation of the iron loss are listed in Table 2.

TABLE 2

| Condition No. | Heating temperature (° C.) | First-pass introduction temperature (° C.) | Iron loss $W_{17/50}$ (W/kg) Average value | Standard deviation | Remarks |
|---|---|---|---|---|---|
| 26 | 150 | 25 | 0.82 | 0.03 | Example |
| 27 | 150 | 40 | 0.85 | 0.04 | Example |
| 28 | 150 | 50 | 0.85 | 0.01 | Example |
| 29 | 150 | 60 | 0.88 | 0.02 | Example |
| 30 | 150 | 70 | 0.98 | 0.05 | Comparative Example |
| 31 | 150 | 80 | 0.97 | 0.04 | Comparative Example |
| 32 | 150 | 90 | 0.98 | 0.03 | Comparative |

TABLE 2-continued

| Condition No. | Heating temperature (° C.) | First-pass introduction temperature (° C.) | Iron loss $W_{17/50}$ (W/kg) Average value | Standard deviation | Remarks |
|---|---|---|---|---|---|
| 33 | 150 | 100 | 1.02 | 0.03 | Example Comparative Example |
| 34 | 150 | 150 (without cooling) | 1.20 | 0.04 | Comparative Example |
| 35 | 150 | 40 | 0.81 | 0.02 | Example |
| 36 | 150 | 50 | 0.80 | 0.03 | Example |
| 37 | 150 | 60 | 0.83 | 0.02 | Example |

Table 2 indicates that the material (coil) in which the first-pass introduction temperature after heating is 60° C. or lower has low iron loss. Further, Table 2 indicates that, when the roughness of work rolls (arithmetic mean roughness Ra) of the first pass is low, the iron loss is further reduced.

Example 2

A steel slab having a composition containing C: 0.06 mass %, Si: 3.4 mass %, and Mn: 0.06 mass %, and containing 90 mass ppm of N, 250 mass ppm of sol. Al, 0.02 mass % of S, and 0.02 mass % of Se, with the balance being Fe and inevitable impurities, was heated to 1400° C. and then subjected to hot rolling to obtain a hot-rolled sheet with a sheet thickness of 2.0 mm.

The hot-rolled sheet was subjected to hot-rolled sheet annealing at 1000° C. for 60 seconds. The hot-rolled sheet obtained after hot-rolled sheet annealing was subjected to cold rolling once using a tandem mill (roll diameter: 300 mm, number of stands: 5) and then subjected to intermediate annealing at 1100° C. for 80 seconds in an atmosphere of $N_2$: 75 vol %+$H_2$: 25 vol % with a dew point of 46° C., and the steel sheet was cooled in the subsequent cooling process from 800° C. to 300° C. at a rate of 20° C./s. Next, final cold rolling was performed using a tandem mill (roll diameter: 300 mm, number of stands: 5) to obtain a cold-rolled sheet with a final sheet thickness of 0.25 mm. During the final cold rolling, the steel sheet was heated to the heating temperature listed in Table 3 by a heating unit installed between a payoff reel and the first pass of rolling stands in the tandem mill, and then the steel sheet was cooled to the temperature (first-pass introduction temperature) listed in Table 3 before being bitten in the first pass of rolling stands.

Next, the cold-rolled sheet was subjected to primary recrystallization annealing that also served as decarburization annealing at a soaking temperature of 840° C. for a soaking time of 100 seconds. Next, an annealing separator mainly composed of MgO was applied to the surface of the steel sheet, and then the steel sheet was subjected to secondary recrystallization annealing.

A coating solution containing phosphate-chromate-colloidal silica in a weight ratio of 3:1:2 was applied to the surface of the steel sheet after the secondary recrystallization annealing, and flattening annealing was performed at 800° C. for 30 seconds to obtain a product coil.

The iron loss of each of 10 product coils prepared under the same conditions was measured, and the average value and the standard deviation were determined. The iron loss was measured by cutting samples from the longitudinal central portion of the coil so that the total weight was 500 g or more, and conducting an Epstein test. The average value and the standard deviation of the iron loss are listed in Table 3.

TABLE 3

| Condition No. | Heating temperature (° C.) | First-pass introduction temperature (° C.) | Iron loss $W_{17/50}$ (W/kg) Average value | Standard deviation | Remarks |
|---|---|---|---|---|---|
| 38 | No heating | 25 | 1.08 | 0.12 | Comparative Example |
| 39 | 50 | 25 | 1.05 | 0.10 | Comparative Example |
| 40 | 60 | 25 | 1.02 | 0.09 | Comparative Example |
| 41 | 70 | 25 | 0.90 | 0.05 | Example |
| 42 | 80 | 25 | 0.88 | 0.04 | Example |
| 43 | 90 | 25 | 0.88 | 0.04 | Example |
| 44 | 100 | 25 | 0.87 | 0.03 | Example |
| 45 | 125 | 25 | 0.86 | 0.01 | Example |
| 46 | 150 | 25 | 0.87 | 0.02 | Example |
| 47 | 175 | 25 | 0.91 | 0.02 | Example |
| 48 | 200 | 25 | 0.92 | 0.03 | Example |
| 49 | 225 | 25 | 1.10 | 0.06 | Comparative Example |
| 50 | 250 | 25 | 1.24 | 0.05 | Comparative Example |
| 51 | 150 | 25 | 0.84 | 0.03 | Example |
| 52 | 150 | 40 | 0.86 | 0.04 | Example |
| 53 | 150 | 50 | 0.88 | 0.01 | Example |
| 54 | 150 | 60 | 0.90 | 0.02 | Example |
| 55 | 150 | 70 | 1.01 | 0.05 | Comparative Example |
| 56 | 150 | 80 | 1.02 | 0.04 | Comparative Example |
| 57 | 150 | 90 | 1.06 | 0.03 | Comparative Example |
| 58 | 150 | 100 | 1.05 | 0.03 | Comparative Example |
| 59 | 150 | 150 | 1.18 | 0.04 | Comparative Example |

As indicated in Table 3, the iron loss properties are good and variations in iron loss is small even when a steel slab containing a large amount of inhibitor is used and cold rolling is performed with intermediate annealing performed therebetween.

Example 3

Steel having a composition containing C: 0.036 mass %, Si: 3.4 mass %, Mn: 0.06 mass %, 50 mass ppm of N, 72 mass ppm of sol. Al, 31 mass ppm of S, and 31 mass ppm of Se, and containing Sb, Cu, P, Cr, Ni, Sn, Nb, Mo, B, and Bi as other components as listed in Table 4, with the balance being Fe and inevitable impurities, was prepared by steelmaking to obtain a steel slab, and the steel slab was heated to 1210° C. and then subjected to hot rolling to obtain a hot-rolled sheet with a sheet thickness of 2.0 mm.

The hot-rolled sheet was subjected to hot-rolled sheet annealing at 1000° C. for 60 seconds, then cooled from 800° C. to 300° C. at a rate of 50° C./s, and then wound into a coil. The hot-rolled sheet obtained after hot-rolled sheet annealing was subjected to cold rolling once using a tandem mill (roll diameter: 300 mm, number of stands: 5) to obtain a cold-rolled sheet with a final sheet thickness of 0.30 mm. In this process, the steel sheet (hot-rolled sheet) was heated to 150° C. by a heating unit installed between a payoff reel and the first pass of rolling stands in the tandem mill. After heating, the steel sheet was cooled to 25° C. before being bitten in the first pass of rolling stands.

Next, the cold-rolled sheet was subjected to primary recrystallization annealing that also served as decarburization annealing at a soaking temperature of 840° C. for a soaking time of 100 seconds. Next, an annealing separator mainly composed of MgO was applied to the surface of the steel sheet, and then the steel sheet was subjected to secondary recrystallization annealing.

A coating solution containing phosphate-chromate-colloidal silica in a weight ratio of 3:1:2 was applied to the surface of the steel sheet after the secondary recrystallization annealing, and flattening annealing was performed at 800° C. for 30 seconds to obtain a product coil.

The iron loss of each of 10 product coils prepared under the same conditions was measured, and the average value and the standard deviation were determined. The iron loss was measured by cutting samples from the longitudinal central portion of the coil so that the total weight was 500 g or more, and conducting an Epstein test. The average value and the standard deviation of the iron loss are listed in Table 4.

| Steel sample | Other components added (mass %) | | | | | | | | | | Iron loss $W_{17/50}$ (W/kg) | |
|---|---|---|---|---|---|---|---|---|---|---|---|---|
| ID | Sb | Cu | P | Cr | Ni | Sn | Nb | Mo | B | Bi | Average value | Standard deviation |
| A1 | — | — | — | — | — | — | — | — | — | — | 0.87 | 0.03 |
| A2 | 0.01 | — | — | — | — | — | — | — | — | 0.01 | 0.83 | 0.03 |
| A3 | 0.01 | — | 0.05 | — | — | — | 0.005 | — | — | — | 0.82 | 0.04 |
| A4 | — | 0.05 | 0.05 | 0.02 | — | — | — | — | — | — | 0.81 | 0.02 |
| A5 | — | — | — | — | 0.05 | 0.02 | 0.005 | — | — | — | 0.80 | 0.03 |
| A6 | — | — | — | — | — | — | — | 0.02 | 0.002 | 0.01 | 0.82 | 0.04 |
| A7 | — | 0.05 | 0.05 | — | 0.05 | — | — | — | — | — | 0.82 | 0.03 |
| A8 | — | — | — | — | — | 0.02 | 0.005 | — | — | 0.01 | 0.81 | 0.04 |
| A9 | — | — | — | 0.02 | — | — | — | 0.02 | 0.002 | — | 0.80 | 0.03 |
| A10 | — | 0.05 | — | — | — | 0.02 | — | — | — | 0.01 | 0.82 | 0.03 |
| A11 | — | — | — | 0.02 | — | 0.02 | — | 0.02 | — | — | 0.82 | 0.01 |
| A12 | — | — | 0.05 | — | — | — | — | — | — | — | 0.84 | 0.03 |
| A13 | — | — | — | — | 0.05 | — | — | — | — | — | 0.84 | 0.04 |
| A14 | — | — | — | — | — | — | — | — | 0.002 | — | 0.83 | 0.02 |

As indicated in Table 4, steel sheets containing at least one of Sb, Cu, P, Cr, Ni, Sn, Nb, Mo, B, and Bi had an iron loss of 0.84 W/kg or less, where the iron loss was significantly reduced, and the variations in the properties in the longitudinal direction of a coil were small.

REFERENCE SIGNS LIST

1 Heating unit
2 Cooling unit
3 Steel strip
4 Rolling roll (rolling stand)
5 Temperature control unit

The invention claimed is:

1. A method of manufacturing a grain-oriented electrical steel sheet, comprising subjecting a steel material to hot rolling to obtain a hot-rolled sheet, subjecting the hot-rolled sheet to cold rolling once or twice or more with intermediate annealing performed therebetween to obtain a cold-rolled sheet with a final sheet thickness, and then subjecting the cold-rolled sheet to decarburization annealing and then to secondary recrystallization annealing, wherein final cold rolling is performed by a tandem mill, and in the final cold rolling, the hot-rolled sheet is heated to a temperature range of 70° C. or higher and 200° C. or lower, then, within 30 seconds after heating, cooled to 60° C. or lower by a method selected from injection of coolant liquid to the sheet, roll cooling, and oil bath, and then introduced into a first pass of the tandem mill.

2. The method of manufacturing a grain-oriented electrical steel sheet according to claim 1, wherein the steel material comprises a chemical composition containing, in mass %, C: 0.01% to 0.10%,
Si: 2.0% to 4.5%,
Mn: 0.01% to 0.5%,
Al: 0.01% to 0.04%,
S: 0.01% to 0.05%,
Se: 0.01% to 0.05%, and
N: 0.0050% to 0.012%, with the balance being Fe and inevitable impurities.

3. The method of manufacturing a grain-oriented electrical steel sheet according to claim 1, wherein the steel material comprises a chemical composition containing, in mass %, C: 0.01% to 0.10%,
Si: 2.0% to 4.5%,
Mn: 0.01% to 0.5%,
Al: less than 0.0100%,
S: 0.0070% or less,
Se: 0.0070% or less, and
N: 0.0050% or less, with the balance being Fe and inevitable impurities.

4. The method of manufacturing a grain-oriented electrical steel sheet according to claim 2, wherein the steel material further contains, in mass %, at least one selected from the group consisting of Sb: 0.005% to 0.50%,
Cu: 0.01% to 1.50%,
P: 0.005% to 0.50%,
Cr: 0.01% to 1.50%,
Ni: 0.005% to 1.50%,
Sn: 0.01% to 0.50%,
Nb: 0.0005% to 0.0100%,
Mo: 0.01% to 0.50%,
B: 0.0010% to 0.007%, and
Bi: 0.0005% to 0.05%.

5. The method of manufacturing a grain-oriented electrical steel sheet according to claim 3, wherein the steel material further contains, in mass %, at least one selected from the group consisting of Sb: 0.005% to 0.50%,
Cu: 0.01% to 1.50%,
P: 0.005% to 0.50%, Cr: 0.01% to 1.50%,
Ni: 0.005% to 1.50%,
Sn: 0.01% to 0.50%,
Nb: 0.0005% to 0.0100%,
Mo: 0.01% to 0.50%,
B: 0.0010% to 0.007%, and
Bi: 0.0005% to 0.05%.

* * * * *